United States Patent [19]

Humphries et al.

[11] Patent Number: 4,532,191

[45] Date of Patent: Jul. 30, 1985

[54] MCRALY CLADDING LAYERS AND METHOD FOR MAKING SAME

[75] Inventors: Michael J. Humphries, Ironia; Chih-an Liu, Edison; Richard C. Krutenat, New Providence, all of N.J.

[73] Assignee: Exxon Research and Engineering Co., Florham Park, N.J.

[21] Appl. No.: 625,038

[22] Filed: Jun. 27, 1984

Related U.S. Application Data

[63] Continuation of Ser. No. 421,246, Sep. 22, 1982, abandoned.

[51] Int. Cl.[3] ..... B05D 1/08; B05D 3/06; B32B 15/00; C23C 5/00

[52] U.S. Cl. ..... 428/678; 428/679; 428/685; 427/34; 427/53.1; 427/423

[58] Field of Search ..... 427/34, 53.1, 423; 428/678, 679, 685

[56] References Cited

U.S. PATENT DOCUMENTS

| | | | |
|---|---|---|---|
| Re. 27,930 | 2/1974 | House | 118/49.5 X |
| T967,009 | 2/1978 | Gale | 427/53.1 |
| 3,310,423 | 3/1967 | Ingham | 427/423 X |
| 4,122,240 | 10/1978 | Banas | 428/655 |
| 4,212,900 | 7/1980 | Serlin | 427/53.1 |
| 4,218,494 | 8/1980 | Belmondo et al. | 427/35 |
| 4,256,779 | 3/1981 | Sokol et al. | 427/34 |
| 4,269,868 | 5/1981 | Livsey | 427/53.1 |
| 4,275,090 | 6/1981 | McComas | 427/34 |
| 4,405,659 | 9/1983 | Strangman | 427/34 X |
| 4,414,249 | 11/1983 | Ulion et al. | 427/34 X |

*Primary Examiner*—Michael R. Lusignan
*Attorney, Agent, or Firm*—Paul E. Purwin

[57] ABSTRACT

A high temperature oxidation resistant alloy of MCrAlY, where M is a base metal comprising iron, cobalt, nickel or a combination thereof, is formed by laser cladding of a coating layer to a substrate.

41 Claims, 1 Drawing Figure

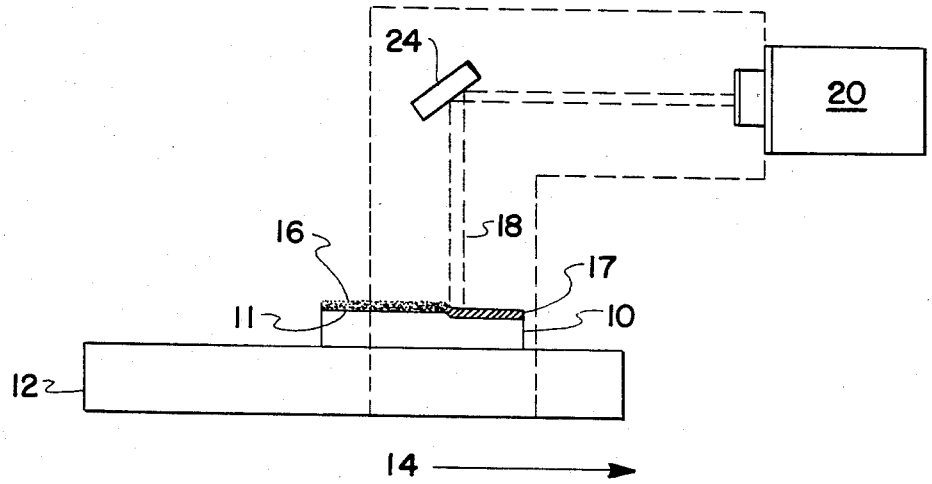
24
20
16
18
17
11
10
12
14

MCRALY CLADDING LAYERS AND METHOD FOR MAKING SAME

This is a continuation of application Ser. No. 421,246, filed Sept. 22, 1982, now abandoned.

BACKGROUND OF THE INVENTION

The present invention relates to laser cladding and more particularly to MCrAlY coatings formed by laser surface fusion. MCrAlY coatings, where M is a base metal of iron, cobalt, nickel or a combination thereof, are generally known in the art. MCrAlY coatings were developed for high temperature oxidation and corrosion protective applications. An ability to form a uniform protective oxide layer which retards further oxidation of the underlying metal made the coating particularly suited to applications in the aerospace industry. Due principally to the alloy's content of active elements such as yittrium and aluminum, preparation of MCrAlY coatings have been confined to high vacuum, typically prepared by physical vapor deposition (alternately referred to herein as P.V.D.) such as with an electron beam. A teaching of one such application may be found in U.S. Pat. No. Re. 27,920. Aside from the evident constraints on the workpiece size and production time, which eliminates physical vapor deposition for many applications and makes it cost prohibitive in others, P.V.D. formed MCrAlY layers require controlled high temperature (about 1700° F.) heat treatment during and/or post deposition. Several such processes require an additional step of glass peening the MCrAlY layer.

A relatively new technology in metallurgical coatings has evolved with the application of high powered lasers to the industry. Generally, a workpiece to be coated is irradiated with an intense laser beam, melting a coating material onto a workpiece surface. The technique may be used to alloy the coating material with the underlying metal such as taught by U.S. Pat. No. 4,212,900, to provide a surface layer having unique properties on a common base substrate such as taught in U.S. Pat. No. 4,218,494 and Defensive Publication No. T 967,009, or utilizing the high energy density to alter surface properties of a material as taught in U.S. Pat. No. 4,122,240. A somewhat modified application uses the laser energy to melt particles of the coating material during their transit from a feedstock source to the coating workpiece. This is generally referred to in the art as "flame spraying," examples of which may be found in U.S. Pat. Nos. 3,310,423 and 4,269,868.

The use of controlled duration high intensity/power density laser irradiation provides an advantage of controlled heating of the coating material and the coating workpiece. That is, in cladding applications such as the present invention, laser cladding permits rapid and selective heating of the coating material and portion of the contiguous substrate surface while maintaining the bulk or body of the coated workpiece at a relatively reduced temperature. The technique consequently permits rapid cooling after irradiation since the bulk of the coated item is not necessarily heated to the melting point of the alloy coating.

SUMMARY OF THE INVENTION

The present invention is directed to a high temperature oxidation resistant cladding of MCrAlY formed by laser fusion of the coating layer to the underlying metal substrate. In the formula MCrAlY, M represents a base metal comprising Iron, Nickel, Cobalt or a combination thereof. Laser irradiation of controlled duration and power density is utilized to fuse the MCrAlY coating layer to the substrate forming a metalurgical bond between the substrate and the coating layer. The workpiece is maintained in an inert atmosphere during laser irradiation to protect the hot process area from oxidation. The process demonstrates a novel advantage in producing relatively small and uniform dispersoids of the oxides of the alloy components required for forming strongly adherent, oxidation resistant films, permitting a lowered aluminum content. The process further eliminates the conventional constraints imposed by physical vapor disposition including preparation under high vacuum and high temperature heat treatments.

BRIEF DESCRIPTION OF THE DRAWINGS

The singular drawing is a side view of an apparatus used in the practice of the present invention.

DETAILED DESCRIPTION OF THE INVENTION

The present invention is directed to a high temperature corrosion resistant MCrAlY cladding having novel metalurgical characteristics and a method for producing same. To illustrate the novel characteristics of the method used in producing the MCrAlY cladding, FIG. 1 describes one embodiment of an apparatus used in fabricating the MCrAlY coatings. A workpiece 10 having a coating surface 11 is generally metallic and preferably a relatively low carbon content iron base alloy. The terminology "relatively low carbon content" as used herein, and generally recognized in the art, refers to an alloy having a carbon content less than about 0.2%.

In the illustrated embodiment, the workpiece 10 is placed or secured on conveyor means 12 which provides lateral movement of the workpiece, illustrated by arrow 14. Due to the collimated nature of laser light, utilizing the conveyor means 12 permits control of the laser beam dwell time upon any specific area of the workpiece within the effective area of the laser beam by means of controlling the speed in which the workpiece is moved into and from the beam.

The coating surface 11 is uniformly covered with a layer of coating material 16 comprising MCrAlY. In the term MCrAlY, M is a base metal comprising iron, cobalt, nickel or a combination thereof. In one embodiment layer 16 comprises MCrAlY powders uniformly spread over the coating surface. Examples of such MCrAlY powders include iron based alloys having about 15% to 30% Cr, 4% to 10% Al, 0.1% to 1.5% Y; cobalt based alloys having about: 15% to 30% Cr, 4% to 10% Al, 0.1% to 1.5% Y; nickel based alloys having about 15% to 30% Cr, 4% to 10% Al, 0.1% to 1.5% Y; and alloys of Fe, Ni, and Co base containing about 60% to 70% of the base elements and the aforedescribed alloying elements. Selection of the powder granulation and the thickness of layer 16 is primarily dependent upon the particular alloy and the desired thickness of the cladding layer. Uniformity of the powder layer 16 can be achieved by any of a number of techniques known to one skilled in the art such as using a template or doctor blade spreading device and automatic powder feeder for example.

The workpiece having layer 16 is transported by conveyor means into the beam path 18 of laser 20. An inert environment, illustrated in the drawing by dashed line 22 is used to envelope at least that portion of the workpiece being irradiated by the laser beam 18. In one embodiment, the inert environment is maintained by blanketing at least the irradiated area with Ar gas.

In a preferred embodiment, the inert environment also envelopes the laser beam path, avoiding absorption of the laser energy by an uncontrolled environment and ionized gases. The laser 20 is generally characterized as comprising a continuous wave (CW) relatively high power (multi kilowatts) laser. The laser is selected to provide strong absorptivity of the output wavelength of the laser by the coating layer 16. In a preferred embodiment, laser 20 comprises a 15 kilowatt $CO_2$ laser to accomplish the melting and fusion of the cladding layer. The use of laser light energy is of further advantage in that upon melting of coating material layer 16, the layer in the molten state becomes highly reflective of the light energy. The reflected energy no longer serves to heat the layer, self-regulating the laser melting process.

In a preferred embodiment, an integrator lens 24 may be interposed between the laser 20 and th workpiece 10 to direct the laser beam energy uniformly over a specific area of the workpiece. Although not shown in the drawing, the lens may also be used to divert or angle the laser beam 18.

Under cover of the inert environment 22, the coating material 16 is irradiated by laser beam 18 for a preselected dwell time. The dwell time is a function of the power density of the laser beam and the composition of the alloy. For example, upon irradiating, the coating material layer is rapidly melted along with a small amount of the underlying substrate coating surface 11. Depending upon the dwell time, about 5% to 50% of the coating comprises material attributable to the melting of the substrate, preferably 10–40%.

Upon movement out of the laser beam 18, the molten alloy is solidified due principally to autoquenching. Conventional cooling capability may be added to the conveyor means or the inert environment to supplement the autoquenching. Using laser energy to melt the coating layer 16 results in a rapid rise rate of temperature which permits the selective heating of the coating material and the area immediately contiguous to the surface without heating the remainder of the workpiece to the high temperatures necessary for the cladding process.

The solidified MCrAlY alloy layer 17 is tenaciously adherent to the underlying substrate. Metallurgical studies reveal the aluminum composition of the MCrAlY to be less than about 6.0%, yet as evidenced in the examples detailed hereinafter the coatings exhibit excellent high temperature oxidation resistance. As presently understood, the rapid heating and cooling results in relatively small, uniform dispersants of the oxides of the alloy components, resulting in the evidenced metallurgical characteristics. The layer thickness dependent as described heretofore upon the thickness of the coating material, generally ranges from about 20 mils to about 80 mils. The coating area may be increased without necessitating larger area laser beams (or multiple beams) by multiple pass processing where a small portion of the previously irradiated layer is remelted.

To assist one skilled in the art, the following examples detail specific embodiments of the present invention.

EXAMPLE I

A type 304 stainless steel substrate, approximately one-quarter inch in thickness was uniformly coated with a powder of FeCrAlY alloy which contained approximately 24.5 percent chromium, 4.0 percent aluminum and 0.5 percent yittrium, by weight, and the balance iron. The powder form having a particulate of about −325 mesh size was evenly spread across the substrate using a template to a thickness of about 0.035 inch. the workpiece was placed onto a conveyor system having a controlled scan speed of about 12 inches per minute. A commercially available $CO_2$ laser was adjusted to provide a power of about 6.5 kilowatts to the surface of the workpiece. An optical integrater lens was used to provide a square beam which at the workpiece surface has an area of about 0.5 inch by 0.5 inch. The conveyor belt was set to provide a scan speed of 12 inches per minutes, which under the conditions specified results in a power density of 4 kilowatts per square centimeter and a dwell time of about 2.5 seconds. Argon was used to envelope the laser beam and the workpiece in the area proximate to the irradiation zpone. Visual observation of the process confirmed virtually instant melting of the alloy powder and solidification upon exiting the irradiation zone.

After cooling, the coating was subjected to oxidation studies which comprised exposing the coated samples in air at temperatures ranging from about 1000° to 1200° C. The uncoated stainless steel substrate rapidly oxidized under these conditions while the segment of the surface coated with the alloy evidenced virtually no oxidation attack. The oxidation study was continued until virtually all of the stainless steel substrate was oxidized leaving only the coating layer.

EXAMPLE II

A powder of CoCrAlY alloy containing 29.5% chromium, 6.0% aluminum and 0.8% yittrium, by weight, the balance being cobalt, was uniformly spread onto the surface of a type 304 stainless steel substrate having a thickness of about one-quarter inch. The powder alloy having a particulate size ranging from about −80 mesh to about +270 mesh was uniformly spread across the surface using a template to a thickness of about 0.035 inch. The laser and conveyor apparatus described in Example I was utilized. The scan speed was set at 14 inches per minute, which for a laser beam delivered through the optical integrator to form a square beam of 0.5 inch by 0.5 inch, resulted in an area power density of 4.0 kilowatts per centimeter square and a dwell time of about 2.1 seconds. Visual observance again confirmed rapid melting of the powders resulting in a coating ranging in thickness from about 0.05 to about 0.06 inches. The coating was subjected to oxidation studies in air between 1000° and 1200° C. in which the CoCrAlY coating evidenced corrosion resistance substantially similar to that described in Example I.

EXAMPLE III

A cladding of FeCrAlY alloy produced in the manner substantially identical to that of Example I was subjected to metallurgical testing. An analysis of the composition of the FeCrAlY coating indicated an average aluminum content of about 2.4 weight percent. The Energy Dispersive X-ray (EDX) analysis in a scanning electron microscope also identified the constituents of the substrate confirming the partial melting of the substrate surface during the irradiation process.

The sample was then subjected to an oxidation study virtually identical to that described in Example I. After 1536 hours at a temperature of about 1000° C., the stainless steel substrate was virtually totally lost to oxidation while the cladding layer of FeCrAlY remained substantially intact.

EXAMPLE IV

A CoCrAlY coating substantially similar to that set forth in Example II was subjected to EDX analysis. The EDX analysis revealed that the layer contained an average of about 4.2 weight percent aluminum. The sample was then subjected to oxidation studies and after exposure to air at an elevated temperature of about 1000° C. for about 1536 hours, the stainless steel substrate was substantially consumed by oxidation, whereas the cladding layer exhibited no significant oxidation.

What is claimed is:

1. A method for producing an oxidation resistant cladding of MCrAlY alloy having about six percent or less by weight Al content, said method comprising:

providing a substrate;

applying a coating layer of MCrAlY to at least a portion of said substrate;

providing an inert ambient to engulf at least the coated portion of said substrate in an inert gas and simultaneously;

irradiating at least a portion of the MCrAlY layer with a laser beam of sufficient power density to concurrently cause melting of the MCrAlY layer and a portion of the substrate contiguous to the molten MCrAlY to form a cladding of MCrAlY metallurgically bonded to the substrate, said MCrAlY cladding having uniform dispersoids of oxides of the alloy.

2. The method of claim 1 wherein said substrate is selected from the group consisting of ferritic or austenitic alloys of Fe, Ni or Co base having a carbon content less than about 0.2%.

3. The method of claim 1 wherein said substrate comprises an iron based alloy.

4. The method of claim 3 wherein said iron base alloy is characterized as having a relatively low carbon content.

5. The method of claim 1 wherein M in the MCrAlY cladding comprises iron, cobalt, nickel, or a combination thereof.

6. The method of claim 5 wherein said cladding of MCrAlY comprises FeCrAlY.

7. The method of claim 6 wherein said coating of FeCrAlY comprises:

(a) from about 59 weight percent to about 81 weight percent iron;

(b) from about 15 weight percent to about 30 weight percent chromium;

(c) from about 4 weight percent to about 10 weight percent aluminum;

(d) from about 0.1 weight percent to about 1.5 weight percent yittrium.

8. The method of claim 7 wherein said coating layer of MCrAlY comprises a particulate of the alloy.

9. The method of claim 8 wherein said particulate coating layer comprises FeCrAlY.

10. The method of claim 9 wherein said FeCrAlY comprises −325 mesh size powder of FeCrAlY uniformly spread upon a coating surface of the substrate to a thickness of about 0.035 inch.

11. The method of claim 10 wherein said substrate comprises type 304 stainless steel.

12. The method of claim 11 wherein said substrate has a thickness of about ¼ inch.

13. The method of claim 1 or 6 wherein said irradiating laser beam is characterized as having an energy density ranging from about 4 kilowatts per $cm^2$ to about 12 kilowatts per $cm^2$ measured proximate to the FeCrAlY cladding.

14. The method of claim 13 wherein the laser is a $CO_2$ laser.

15. The method of claim 13 wherein the inert gas engulfing the coated substrate is selected to be substantially non-absorbing of the warelength of the laser beam.

16. The method of claim 13 wherein said irradiating continues for a period of time ranging from about 0.5 seconds to about 6.0 seconds to resulting in a FeCrAlY cladding layer ranging in thickness from about 0.02 inch to about 0.15 inch.

17. The method of claim 16 wherein said irradiation is further characterized as moving the coated substrate into and from said laser beam where with respect to any respective area of the coated substrate irradiation time ranges from about 0.5 seconds to about 6.0 seconds.

18. The method of claim 17 wherein said laser beam has an intensity of about 4.0 kilowatts per $Cm^2$ and the irradiation time is about 2.5 seconds.

19. The method of claim 18 wherein said cladding of CoCrAlY comprises:

(a) from about 59 weight percent to about 81 weight percent cobalt;

(b) from about 15 weight percent to about 30 weight percent chromium;

(c) from about 4 weight percent to about 10 weight percent aluminum;

(d) from about 0.1 weight percent to about 1.5 weight percent yittrium.

20. The method of claim 19 wherein said coating layer comprises particulate CoCrAlY.

21. The method of claim 20 wherein said CoCrAlY comprises a powder of CoCrAlY ranging in granulation from about −80 mesh to about +270 mesh size, uniformly spread upon a coating surface of the substrate to a thickness of about 0.035 inch.

22. The method of claim 21 wherein said substrate comprises type 304 stainless steel.

23. The method of claim 22 wherein said substrate has a thickness of about ¼ inch.

24. The method of claim 18 wherein said irradiating laser beam is characterized as having an energy density ranging from about 4.0 kilowatts per cm to about 12.0 kilowatts per cm measured proximate to the FeCrAlY cladding.

25. The method of claim 24 wherein the laser is a $CO_2$ laser.

26. The method of claim 24 wherein the inert gas engulfing the coated substrate is selected to be substantially non-absorbing of the wavelength of the laser beam.

27. The method of claim 26 or 15 wherein said inert gas comprises Argon.

28. The method of claim 26 or 15 wherein said inert gas comprises a mixture of Argon and Helium.

29. The method of claim 28 wherein said inert gas comprises about 20% Helium.

30. The method of claim 24 wherein said irradiating continues for a period of time ranging from about 0.5 seconds to about 6.0 seconds.

31. The method of claim 30 wherein said irradiating is further characterized as moving the coated substrate into and from said laser beam where with respect to any respective area of the coated substrate irradiation time ranges from about 0.5 seconds to about 6.0 seconds.

32. The method of claim 31 wherein said laser beam power density is about 4.0 kilowatts per cm and said irradiation time is about 2.1 seconds.

33. An oxidation resistant laser cladded substrate comprising:

a metallic substrate having a carbon content of less that about 0.2%;

an alloy layer of MCrAlY coating where M is iron, cobalt, nickel or a combination thereof and Al content is less than about 6.0%, said layer including a metallurgical bonding region adjacent to said substrate containing about 5% to about 50% of materials contained in said substrate whereby said alloy layer is metallurgically bonded to said substrate.

34. The cladded substrate of claim 33 wherein said substrate is an iron based alloy.

35. The cladded substrate of claim 34 wherein said iron based alloy comprises an alloy having Fe, Cr, Ni and less than about 0.2% C.

36. The cladded substrate of claim 34 wherein said substrate is type 304 stainless steel.

37. The cladded substrate of claim 33 or 36 wherein said MCrAlY coating comprises FeCrAlY.

38. The cladded substrate of claim 37 wherein the Al content comprises about 2.4 weight percent.

39. The cladded substrate of claim 33 or 36 wherein said MCrAlY layer comprises CoCrAlY.

40. The cladded substrate of claim 39 wherein the Al content comprises about 4.2 weight percent.

41. The cladded substrate of claim 33 wherein said metallurgical bonding region comprises about 10% to about 40% of materials contained in said substrate.

* * * * *